US009249986B2

(12) United States Patent
Hazzard et al.

(10) Patent No.: US 9,249,986 B2
(45) Date of Patent: Feb. 2, 2016

(54) MOUNTING BRACKET FOR USE WITH A WATER HEATER

(75) Inventors: Fritz Hazzard, Plymouth, MN (US); Gregory Young, Richfield, MN (US); Don C. Kennedy, Brooklyn Park, MN (US)

(73) Assignee: Honeywell International Inc., Morristown, NJ (US)

( * ) Notice: Subject to any disclaimer, the term of this patent is extended or adjusted under 35 U.S.C. 154(b) by 1005 days.

(21) Appl. No.: 12/794,593

(22) Filed: Jun. 4, 2010

(65) Prior Publication Data

US 2011/0147552 A1 Jun. 23, 2011

Related U.S. Application Data

(63) Continuation-in-part of application No. 12/642,449, filed on Dec. 18, 2009.

(51) Int. Cl.

| | |
|---|---|
| ***A47B 96/06*** | (2006.01) |
| ***F24H 9/06*** | (2006.01) |
| ***F24H 9/18*** | (2006.01) |

(52) U.S. Cl.

CPC ..... *F24H 9/06* (2013.01); *F24H 9/1818* (2013.01); *F24H 9/1836* (2013.01)

(58) Field of Classification Search

None

See application file for complete search history.

(56) References Cited

U.S. PATENT DOCUMENTS

| | | | |
|---|---|---|---|
| 3,847,350 | A | 11/1974 | Thompson |
| 3,849,350 | A | 11/1974 | Matsko |
| 4,324,944 | A | 4/1982 | Weihrich et al. |
| RE30,936 | E | 5/1982 | Kmetz et al. |
| 4,333,002 | A | 6/1982 | Kozak |
| 4,467,178 | A | 8/1984 | Swindle |
| 4,508,261 | A | 4/1985 | Blank |
| 4,511,790 | A | 4/1985 | Kozak |
| 4,568,821 | A | 2/1986 | Boe |
| 4,588,875 | A | 5/1986 | Kozak et al. |
| 4,692,598 | A | 9/1987 | Yoshida et al. |

(Continued)

FOREIGN PATENT DOCUMENTS

| | | |
|---|---|---|
| EP | 0356609 | 3/1990 |
| EP | 0699316 | 7/1999 |

(Continued)

OTHER PUBLICATIONS

U.S. Appl. No. 10/911,151 filed Aug. 3, 2004.

(Continued)

*Primary Examiner* — Monica Millner

(74) *Attorney, Agent, or Firm* — Seager, Tufte & Wickhem LLP

(57) ABSTRACT

A mounting bracket for mounting a temperature sensor, a gas valve, a power delivery unit, a controller and/or any other suitable object or device to a water heater tank or other appliance. An illustrative but non-limiting example may be found in a mounting bracket that includes a polymeric body that has a sensor portion configured to receive a temperature sensor. The sensor portion may have a distal end that extends into and supports the temperature sensor within the water heater tank. The polymeric body may also includes a threaded portion that is configured to threadably engage a threaded spud in a water heater tank such that the distal end of the sensor portion extends into the water tank of the water heater. Various features for increasing the strength and durability of the bracket are also disclosed.

16 Claims, 15 Drawing Sheets

(56) References Cited

U.S. PATENT DOCUMENTS

| | | | | |
|---|---|---|---|---|
| 4,696,639 | A | 9/1987 | Bohan, Jr. | |
| 4,734,658 | A | 3/1988 | Bohan, Jr. | |
| 4,742,210 | A | 5/1988 | Tsuchiyama et al. | |
| 4,770,629 | A | 9/1988 | Bohan, Jr. | |
| 4,834,284 | A | 5/1989 | Vandermeyden | |
| 4,984,981 | A | 1/1991 | Pottebaum | |
| 4,986,468 | A | 1/1991 | Deisinger | |
| 5,007,156 | A | 4/1991 | Hurtgen | |
| 5,103,078 | A | 4/1992 | Boykin et al. | |
| 5,442,157 | A | 8/1995 | Jackson | |
| 5,622,200 | A | 4/1997 | Schulze | |
| 5,660,328 | A | 8/1997 | Momber | |
| 5,779,143 | A | 7/1998 | Michaud et al. | |
| 5,797,358 | A | 8/1998 | Brandt et al. | |
| 5,896,089 | A | 4/1999 | Bowles | |
| 5,968,393 | A | 10/1999 | Demaline | |
| 5,975,884 | A | 11/1999 | Dugger | |
| 6,053,130 | A | 4/2000 | Shellenberger | |
| 6,059,195 | A | 5/2000 | Adams et al. | |
| 6,069,998 | A | 5/2000 | Barnes et al. | |
| 6,075,923 | A | 6/2000 | Wu | |
| 6,208,806 | B1 | 3/2001 | Langford | |
| 6,212,894 | B1 | 4/2001 | Brown et al. | |
| 6,261,087 | B1 | 7/2001 | Bird et al. | |
| 6,271,505 | B1 | 8/2001 | Henderson | |
| 6,293,471 | B1 | 9/2001 | Stettin et al. | |
| 6,350,967 | B1 | 2/2002 | Scott | |
| 6,363,218 | B1 | 3/2002 | Lowenstein et al. | |
| 6,371,057 | B1 * | 4/2002 | Henderson | 122/14.2 |
| 6,375,087 | B1 | 4/2002 | Day et al. | |
| RE37,745 | E | 6/2002 | Brandt et al. | |
| 6,553,946 | B1 * | 4/2003 | Abraham et al. | 122/14.22 |
| 6,560,409 | B2 | 5/2003 | Troost, IV | |
| 6,633,726 | B2 | 10/2003 | Bradenbaugh | |
| 6,701,874 | B1 | 3/2004 | Schultz et al. | |
| 6,732,677 | B2 * | 5/2004 | Donnelly et al. | 122/504 |
| 6,795,644 | B2 | 9/2004 | Bradenbaugh | |
| 6,861,621 | B2 | 3/2005 | Ghent | |
| 6,880,493 | B2 | 4/2005 | Clifford | |
| 6,934,862 | B2 | 8/2005 | Sharood et al. | |
| 6,936,798 | B2 | 8/2005 | Moreno | |
| 6,955,301 | B2 | 10/2005 | Munsterhuis et al. | |
| 6,959,876 | B2 | 11/2005 | Chian et al. | |
| 6,973,819 | B2 * | 12/2005 | Ruhland et al. | 73/23.31 |
| 7,088,238 | B2 | 8/2006 | Karaoguz et al. | |
| 7,117,825 | B2 | 10/2006 | Phillips | |
| 7,137,373 | B2 * | 11/2006 | Seymour et al. | 123/90.5 |
| 7,162,150 | B1 * | 1/2007 | Welch et al. | 392/455 |
| 7,221,862 | B1 | 5/2007 | Miller et al. | |
| 7,252,502 | B2 | 8/2007 | Munsterhuis | |
| 7,317,265 | B2 | 1/2008 | Chian et al. | |
| 2004/0042772 | A1 | 3/2004 | Whitford et al. | |
| 2004/0267385 | A1 | 12/2004 | Lingemann | |
| 2005/0077368 | A1 | 4/2005 | Zak et al. | |
| 2005/0147401 | A1 | 7/2005 | Baxter | |
| 2005/0147402 | A1 | 7/2005 | Baxter | |
| 2005/0150967 | A1 | 7/2005 | Chapman, Jr. et al. | |
| 2006/0243816 | A1 | 11/2006 | Teti | |
| 2007/0023333 | A1 | 2/2007 | Mouhebaty et al. | |
| 2007/0034169 | A1 | 2/2007 | Phillips | |
| 2007/0191994 | A1 | 8/2007 | Patterson et al. | |
| 2007/0246551 | A1 | 10/2007 | Phillips et al. | |
| 2007/0295823 | A1 | 12/2007 | Yamada et al. | |
| 2008/0023564 | A1 | 1/2008 | Hall | |
| 2008/0188995 | A1 | 8/2008 | Hotton et al. | |
| 2010/0095906 | A1 * | 4/2010 | Leeland et al. | 122/14.22 |
| 2010/0133258 | A1 * | 6/2010 | Fima | 219/482 |

FOREIGN PATENT DOCUMENTS

| | | |
|---|---|---|
| GB | 2211331 | 6/1999 |
| JP | 8264469 | 10/1996 |
| JP | 2008008548 | 1/2008 |

OTHER PUBLICATIONS

Lennox, "Network Control Panel, User's Manual," 18 pages, Nov. 1999.

Moog, "M3000 Control System, RTEMP 8, Remote 8-Channel Temperature Controller with CanOpen Interface," 6 pages, Nov. 2004.

* cited by examiner

MOUNTING BRACKET FOR USE WITH A WATER HEATER

This application is a Continuation-In-Part (CIP) of U.S. patent application Ser. No. 12/642,449, filed Dec. 18, 2009, and entitled "MOUNTING BRACKET FOR USE WITH A WATER HEATER", which is incorporated hereby by reference.

TECHNICAL FIELD

The disclosure relates generally to water heaters, and more particularly, to a mounting bracket for a water heater for mounting a temperature sensor, a gas valve, a power delivery unit, a controller and/or any other suitable object or device to the water heater.

BACKGROUND

Water heaters are used in homes, businesses and just about any establishment having the need for heated water. A conventional water heater typically has at least one heating element or "heater," such as a gas-fired and/or electric burner. Each water heater also typically has at least one thermostat or controller for controlling the heater. The controller typically receives signals related to the temperature of the water within the water heater tank, often from a temperature sensor that is thermally engaged with the water in the water heater tank.

In some instances, a water heater may operate in accordance with a first temperature set point and a second temperature set point. The difference between the first and second temperature set point may be referred to as the temperature differential of the water heater. When temperature signals from the temperature sensor indicate that the water temperature is below the first set point, for example when the water temperature is below about 120° F., the controller may turn on the heater and the water within the water heater tank begins to heat. After some time, the water temperature within the water heater tank will increase to the second set point, which, for example may be about 140° F. At this point, the controller may cause the heater to reduce its heat output or, alternatively, causes the heater to turn off. This heat cycle begins again when the water temperature within the water heater tank cools down below the first set point.

For a gas fired water heater, a temperature sensor, a gas valve and a controller are often mounted relative to the water heater tank. The controller typically receives a temperature signal from the temperature sensor. The temperature sensor often protrudes into and is thermally coupled to the water in the water heater tank. The controller typically is programmed to control the gas valve such that the temperature of the water in the water heater tank remains between the first and second temperature set points, as described above. For an electric water heater, a temperature sensor, a power delivery unit and a controller may be mounted to the water heater tank. In this case, the controller may control the power delivery unit such that the temperature of the water in the water heater tank is kept between the first and second temperature set points.

What would be desirable is an improved mounting bracket for mounting the temperature sensor, the gas valve, the power delivery unit, the controller and/or any other suitable object or device to the water heater tank.

SUMMARY

The present disclosure pertains generally to an improved mounting bracket for mounting a temperature sensor, a gas valve, a power delivery unit, a controller and/or any other suitable object or device to a water heater tank. An illustrative but non-limiting example of the disclosure may be found in a mounting bracket that includes a polymeric body that has a sensor portion configured to receive a temperature sensor. The sensor portion may have a distal end that extends into and supports the temperature sensor within the water heater tank. The polymeric body may also include a threaded portion that is configured to threadably engage a threaded spud in a water heater tank such that the distal end of the sensor portion extends into the water tank of the water heater.

In some cases, the sensor portion may include an elongated stem that has an internal well for receiving the temperature sensor. The threaded portion may extend around the elongated stem. In some instances, the elongated stem may include a thread lead in region between the threaded portion and the distal end of the elongated stem. The thread lead in region may help guide the mounting bracket relative to the water heater while the sensor portion is inserted into the water heater tank but before the threaded portion of the stem threadably engages the threaded spud of the water heater. In some cases, the distal end of the elongated stem may include a blade element that can be used to help pierce a barrier or the like of the water heater when the mounting bracket is installed on the water heater.

In some embodiments, the mounting bracket may include a component retaining region. The component retaining region may be use to retain a gas valve, a power delivery unit, a controller and/or any other suitable object or device relative to the water heater tank. In some cases, the component retaining region may include two or more ribs for providing additional support to the component retaining region. In some instances, the two or more ribs may radiate out from the elongated stem, but this is not required. In some cases, the polymeric body may be molded as a single piece, and may be made from a material that, when sufficiently stressed, suddenly fractures in a clean break, such as some nylon materials. In some instances, the polymeric body may be configured to suddenly fracture at or near an outside edge of the threaded spud, but this is not required in all embodiments.

BRIEF DESCRIPTION OF THE FIGURES

The following description should be read with reference to the drawings. The drawings, which are not necessarily to scale, depict selected embodiments and are not intended to limit the scope of the disclosure. The disclosure may be more completely understood in consideration of the following detailed description of various embodiments in connection with the accompanying drawings, in which.

Figure 1:
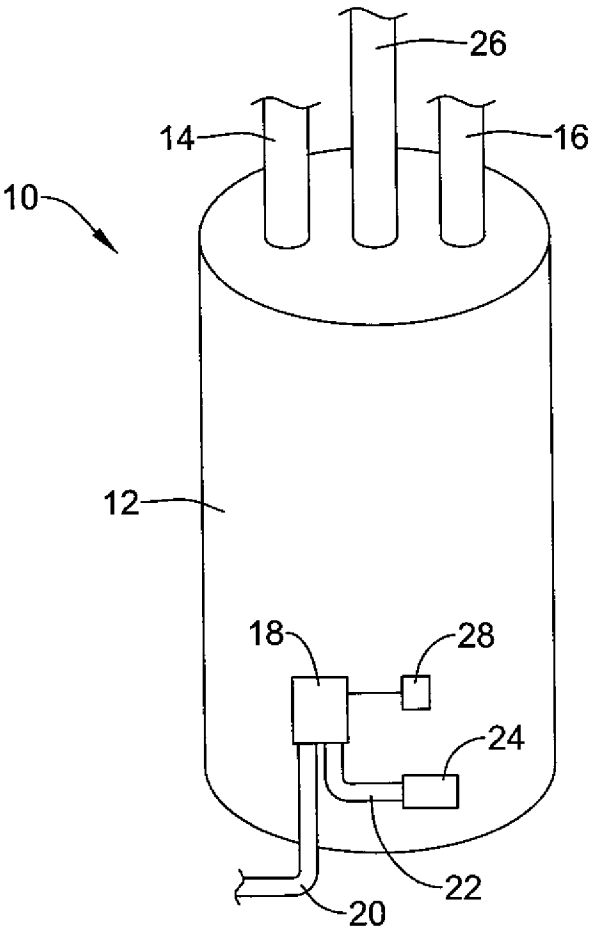
FIG. 1 is a schematic view of an illustrative but non-limiting water heater in accordance with the present disclosure.

While the invention is amenable to various modifications and alternative forms, specifics thereof have been shown by way of example in the drawings and will be described in detail. It should be understood, however, that the intention is not to limit the invention to the particular illustrative embodiments described. On the contrary, the intention is to cover all modifications, equivalents, and alternatives falling within the spirit and scope of the invention.

DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions ranges and/or values pertaining to various components, features and/or specifications are disclosed, one of skill in the art, incited by the present disclosure, would understand desired dimensions, ranges and/or values may deviate from those expressly disclosed.

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

FIG. 1 provides a schematic view of an illustrative but non-limiting water heater 10. Water heater 10 includes a water tank 12. The water tank 12 may include an insulating layer (not explicitly shown) positioned about the water tank 12 to help reduce thermal losses from the water tank 12. Cold water enters water tank 12 through a cold water line 14 and is heated by a gas burner 24. In some cases, the water heater 10 may include an electric heating element rather than a gas burner 24. A power delivery unit (not shown) may be used to selectively apply power (i.e. current) to the electric heating element. In either case, the resulting heated water exits through a hot water line 16. For gas-fired water heaters, a gas control unit 18 such as a gas valve regulates gas flow from a gas source 20 through a combustion gas line 22 and into gas burner 24. A flue 26 permits combustion byproducts to safely exit.

Figure 2:
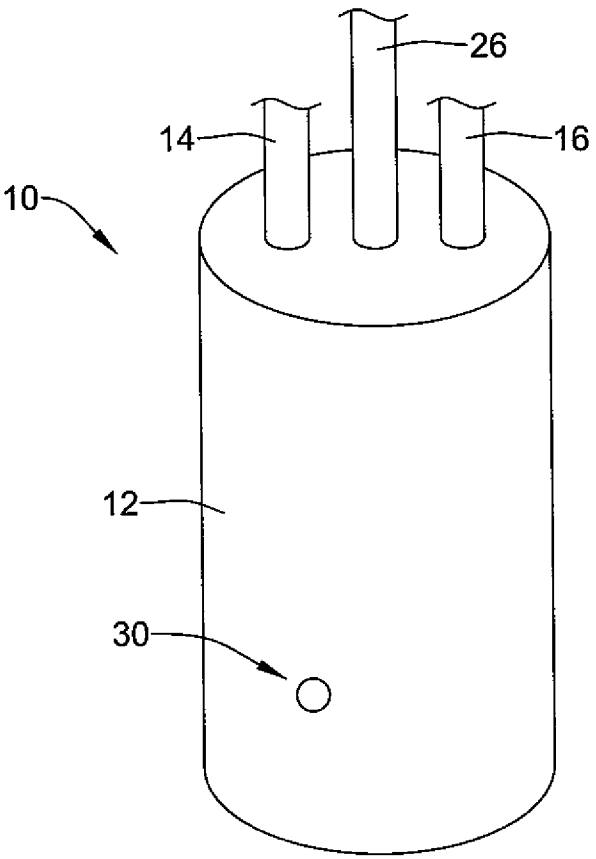
FIG. 2 is a schematic view of an illustrative but non-limiting water heater in accordance with the present disclosure.

As can be seen, water heater 10 includes a temperature sensor 28. In some cases, temperature sensor 28 may enter water tank 12 at a location laterally offset from gas control unit 18. In some instances, however, temperature sensor 28 may instead be located behind gas control unit 18, and in some cases, may be supported and retained by a common mounting bracket such as that described more fully below. In any event, water tank 12 may include an aperture 30 that is sized and configured to accept temperature sensor 28. This can be seen in FIG. 2, in which certain elements of FIG. 1 have been removed for clarity. Aperture 30 may include threads that are configured to accommodate corresponding matching threads on temperature sensor 28. In some cases, temperature sensor 28 has a compression or frictional fit within aperture 30. In other instances, water tank 12 may include a threaded spud (not explicitly shown) that is configured to receive temperature sensor 28.

Figure 3:
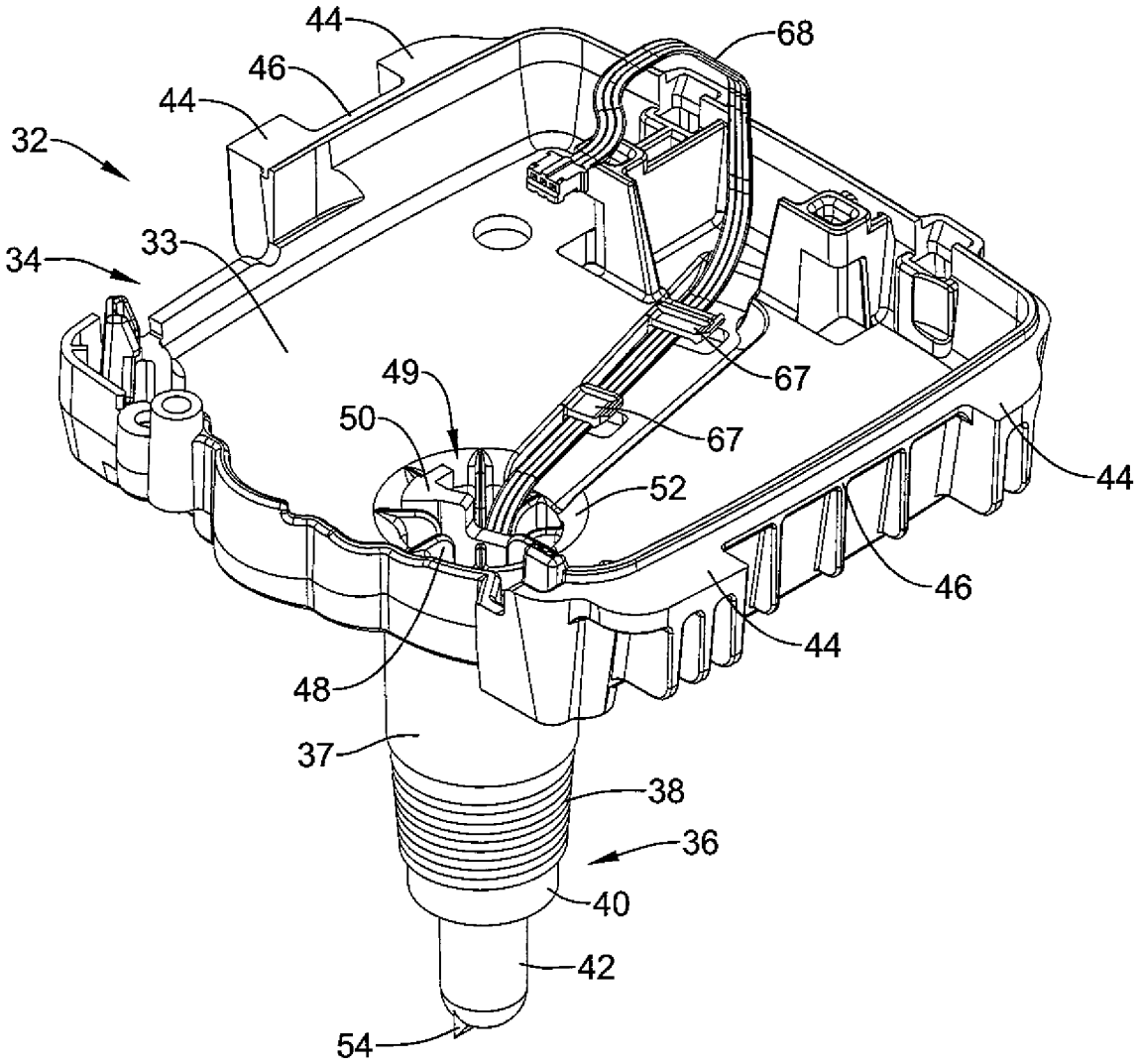
FIG. 3 is a perspective view of an illustrative but non-limiting mounting bracket that may be used in conjunction with the water heater of FIG. 1.

FIG. 3 is a perspective view of an illustrative but non-limiting mounting bracket 32 that may be used in conjunction with the water heater 10. In some instances, the mounting bracket 32 may include a component retaining region 33 and a sensor portion 36 forming an elongated stem. Bracket 32 may be configured to retain a gas valve module and/or a water heater controller module (not explicitly shown) within component retaining region 33, as well as a temperature sensor assembly 49 (see also FIG. 4) within elongated sensor portion 36. In the illustrative embodiment, bracket 32 includes a gas valve retaining portion 34 and a sensor portion 36. Gas valve retaining portion 34 may form at least a portion of a housing of a gas control unit, such as gas control unit 18 of FIG. 1, but this is not required. In some instances, as illustrated, elongated sensor portion 36 may include a threaded portion 38 that can be used to secure bracket 32 to or within aperture 30 (FIG. 2) of water heater spud.

Bracket 32 may be formed of any suitable material. In some cases, bracket 32 may include non-metallic materials such as a polymeric material, glass, ceramic, plastic, and the like. In some cases, bracket 32 may be manufactured as a single piece by injection molding a nylon material such Zytel® 70G33 glass-filled nylon, available from DuPont in Wilmington, Del. The thermal conductivity of such non-metallic materials may be less than those of metallic materials, and as a result, may partially thermally isolate the temperature sensor assembly 49 from the water in the water tank 12, but may be less expensive to produce than a metallic well. It is contemplated that in some cases, bracket 32 may not be formed entirely from the same material, or bracket 32 may not be formed as a single piece. As will be discussed in more detail with respect to FIG. 7, bracket 32 may incorporate safety features to prevent injury from hot water in the event bracket 32 becomes broken or damaged after installation.

Sensor portion 36 of the bracket 32 may include an elongated stem extending from component retaining region 33. Sensor portion 36 may include an internal well 39 (shown in more detail in FIGS. 4 and 4A) for receiving a temperature sensor assembly 49. The elongated stem of sensor portion 36 may include of several different regions. For example, sensor portion 36 may include a first portion 37, a threaded region 38 extending around the exterior of the sensor portion 36, a thread lead-in region 40, and an enclosed distal end region 42. Threaded region 38 may be configured to threadably engage a threaded spud in the water tank 12. Thread lead-in region 40 may be disposed between the distal end region 42 and the threaded region, and may be configured to help guide the sensor portion 36 into the aperture 30 of the water tank 12 with proper alignment for the threaded region 38 to engage the threaded spud in the water tank 12. In some embodiments, the thread lead-in region 40 may have zero draft for maximum effectiveness, but this is not required. When threaded region 38 is engaged with the threaded water heater spud, distal end 42 may be disposed within water tank 12. Distal end 42 may house a temperature sensor such that when the bracket 32 is engaged with the water tank 12, the temperature sensor is in at least partial thermal contact with the water in the water tank 12.

In some instances, distal end region 42 may have a reduced cross-sectional area relative to remaining regions 37, 38 and 40 of sensor portion 36. However, it is contemplated that in some cases, the cross-sectional area of distal end 42 may be the same as, or substantially the same as the remaining regions 37, 38 and 40 of sensor portion 36. In some embodiments, distal end 42 may include a cutting element 54 disposed at or near the tip. In some instances, the cutting element 54 may include a blade-like feature. Cutting element 54 may be capable of puncturing and/or piercing a plastic sheet or barrier commonly wrapped around the water tank 12 of many water heaters during installation of the bracket 32. It is contemplated that in some cases, the cutting element 54 may be omitted from the design.

In some embodiments, bracket 32 may also include two (or more) bosses 44 on a first lateral side, and two (or more) bosses 44 on a second opposing lateral side. While bracket 32 is shown having four bosses 44, it is contemplated that bracket 32 may have any number of bosses 44 as desired, for example, but not limited to, one, two, three, or more. Additionally, it is contemplated that bosses 44 may be disposed on fewer than, or more than, two lateral sides. Bosses 44 may provide, among other things, an area for torque to be applied directly to the bracket 32 during installation. For example, an installation tool may grip and apply torque to bosses 44 to threadably engage threaded region 38 of sensor portion 36 with the threaded water heater spud on a water tank 12. In some instances, bosses 44 may further include a rib 46 disposed between adjacent bosses 44. Rib(s) 46 may provide additional support to the bracket 32, and may also help prevent an installation tool from contacting the component retaining region 33 of bracket 32 during installation.

Figure 4:
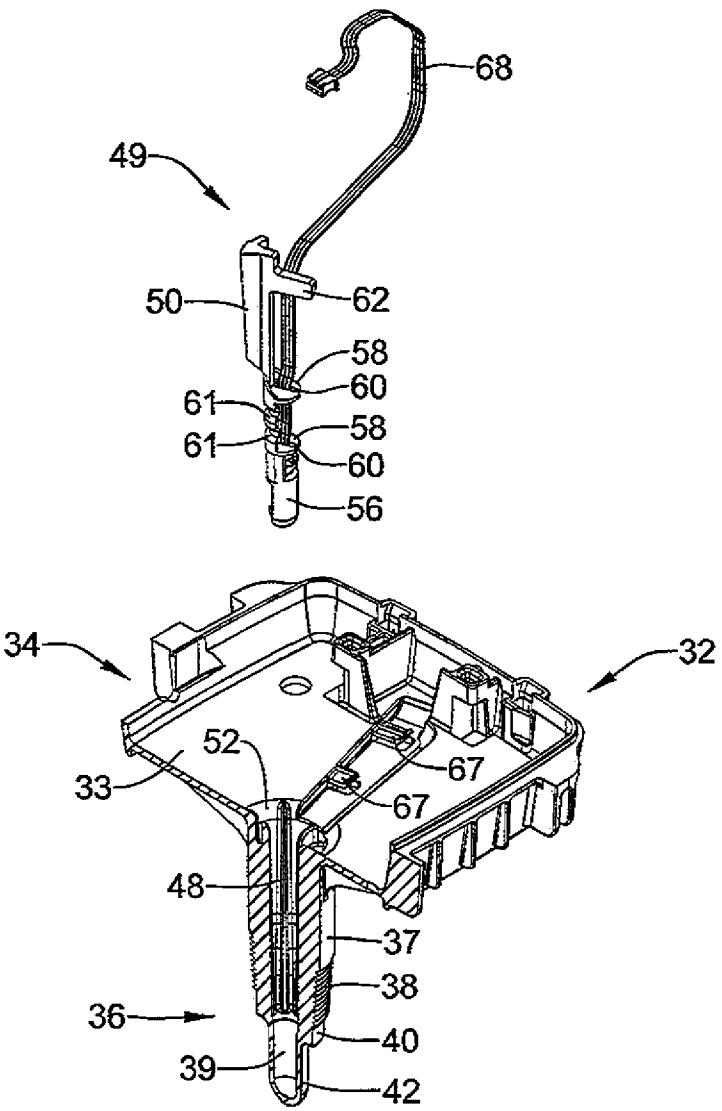
FIG. 4 is a perspective view, partially in cross-section, of an illustrative but non-limiting mounting bracket and temperature sensor assembly.

Turning now to FIG. 4, which is a perspective view, partially in cross-section, of an illustrative but non-limiting mounting bracket 32 and temperature sensor assembly 49. The temperature sensor assembly 49 is shown pulled out of the sensor region 36 and situated above the bracket 32 in an exploded view form. As can be seen, the sensor portion 36 may be configured to accommodate the temperature sensor assembly 49. In the illustrative embodiment, temperature sensor assembly 49 includes one or more heat traps 58 that are attached to or otherwise secured to sensor assembly structure 50, and may serve to help limit or at least partially limit heat flow out of the sensor portion 36 of the bracket 32. Sensor assembly structure 50 may further include one or more convolutions 61. When the sensor assembly structure 50 is assembled within sensor portion 36, convolutions 61 may apply a spring-like force that holds the temperatures sensor 56 in tight contact with the bottom of the internal well 39. Convolutions 61 may also reduce the need to use a fastener to secure the temperature sensor assembly 49. Temperature sensor assembly 49 may be configured to accommodate a temperature sensor 56. In some cases, temperature sensor 56 may be a single temperature sensor. In other instances, temperature sensor 56 may include multiple temperature sensors, which may provide a measure of redundancy and/or increased accuracy in a corresponding temperature measurement. In some cases, the temperature sensor 56 may include a thermopile or thermocouple.

During assembly, it will be appreciated that heat traps 58 and temperature sensor 56 may be attached to a sensor assembly structure 50. This may be accomplished by snap fits, frictional fits, glue, screws, rivets, or any other suitable attachment mechanism. In some instances, heat traps 58 may be integrally molded or otherwise formed as part of sensor assembly structure 50. In some cases, the heat traps 58 may each include a slot 60 in order to accommodate and/or secure a wiring harness 68 for the temperature sensor 56. Once heat traps 58 and temperature sensor 56 have been secured or otherwise attached to sensor assembly structure 50, sensor assembly structure 50 may be inserted into a void 52 that is molded or otherwise formed within sensor portion 36. It can be seen that sensor assembly structure 50 may include one or more protrusions such as protrusion 62 that may help to locate sensor assembly structure 50 within void 52 and/or limit penetration of sensor assembly structure 50 into void 52 while allowing wiring harness 68 to pass without being pinched. The one or more protrusions 62 may align the sensor assembly structure 50 with inwardly extending ribs 48 disposed on the inner walls of the sensor portion 36 and into the void. One or more protrusions 62 in cooperation with one or more ribs 48 may, in some instances, help properly align and assemble the temperature sensor assembly 49 within the sensor portion 36. One or more protrusions 62 may also ensure that sensor assembly 49 is not installed in the wrong bracket. As can be seen, when temperature sensor assembly 49 is assembled within sensor portion 36, sensor 56 may be disposed within an internal well 39 within the distal tip portion 42 of the sensor portion.

Figure 4A:
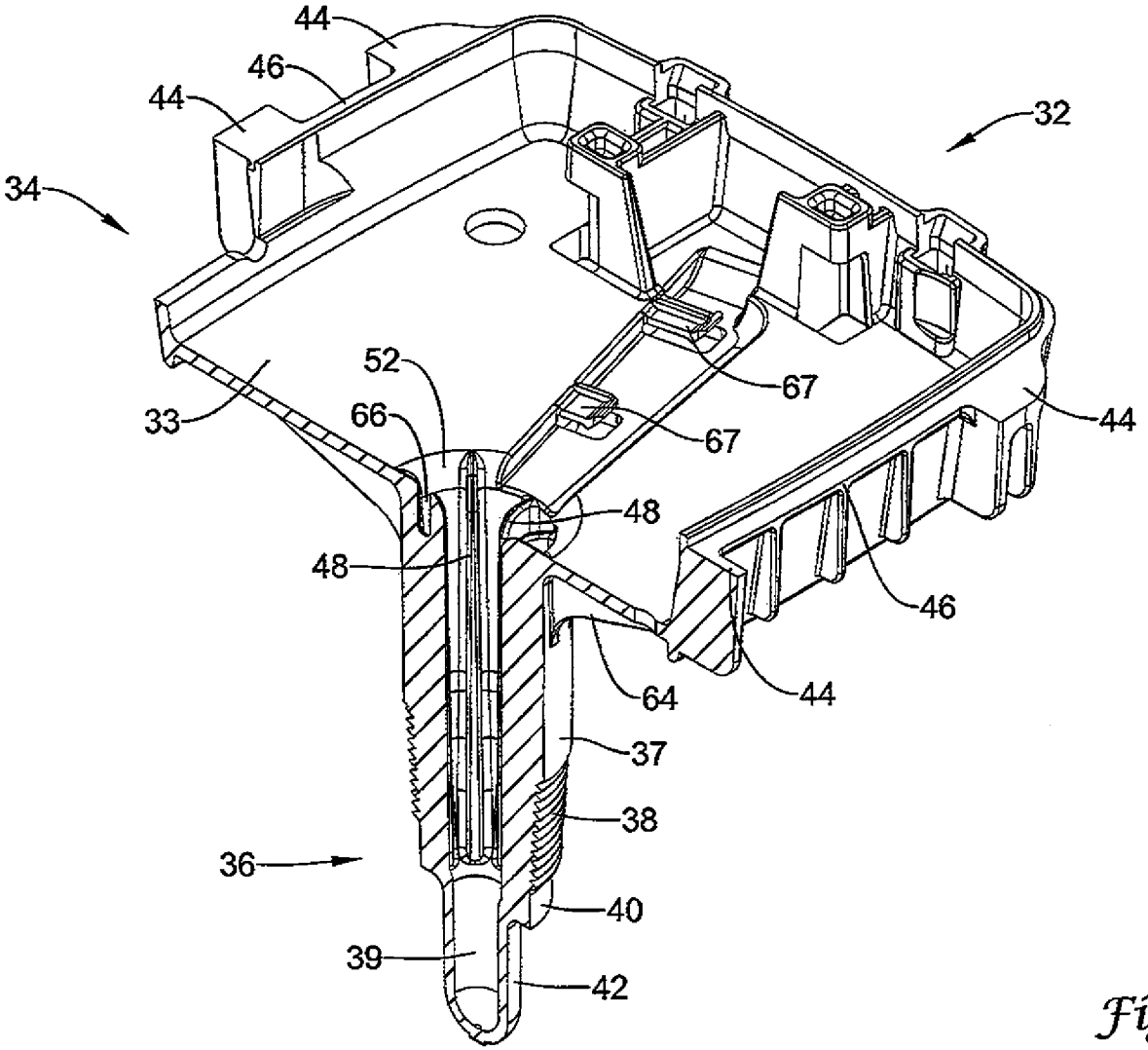
FIG. 4A is a perspective view, partially in cross-section, of the illustrative but non-limiting mounting bracket of FIG. 4, with the temperature sensor assembly not shown.

FIG. 4A is a perspective view, partially in cross-section, of the illustrative but non-limiting mounting bracket of FIG. 4, with the temperature sensor assembly not shown. As discussed above, the void 52 within the sensor region 36 may include inwardly extending ribs 48. Ribs 48 may extend any length along the void 52, as desired. While ribs 48 are shown extending to a distal end of threaded region 38, it is contemplated in some embodiments, ribs 48 may extend past threaded region 38. In other embodiments, ribs 48 may terminate short of threaded region 38, or at any point within threaded region 38. It is further contemplated that there may be any number of ribs 48 as desired, for example, but not limited to, one, two, three, four, or more. In some embodiments, sensor portion 36 may include one or more slots 66 for receiving one or more protrusions such as protrusion 62 that may help locate temperature assembly structure 50 within void 52 and/or limit penetration of temperature assembly structure 50 into void 52.

Figure 5:
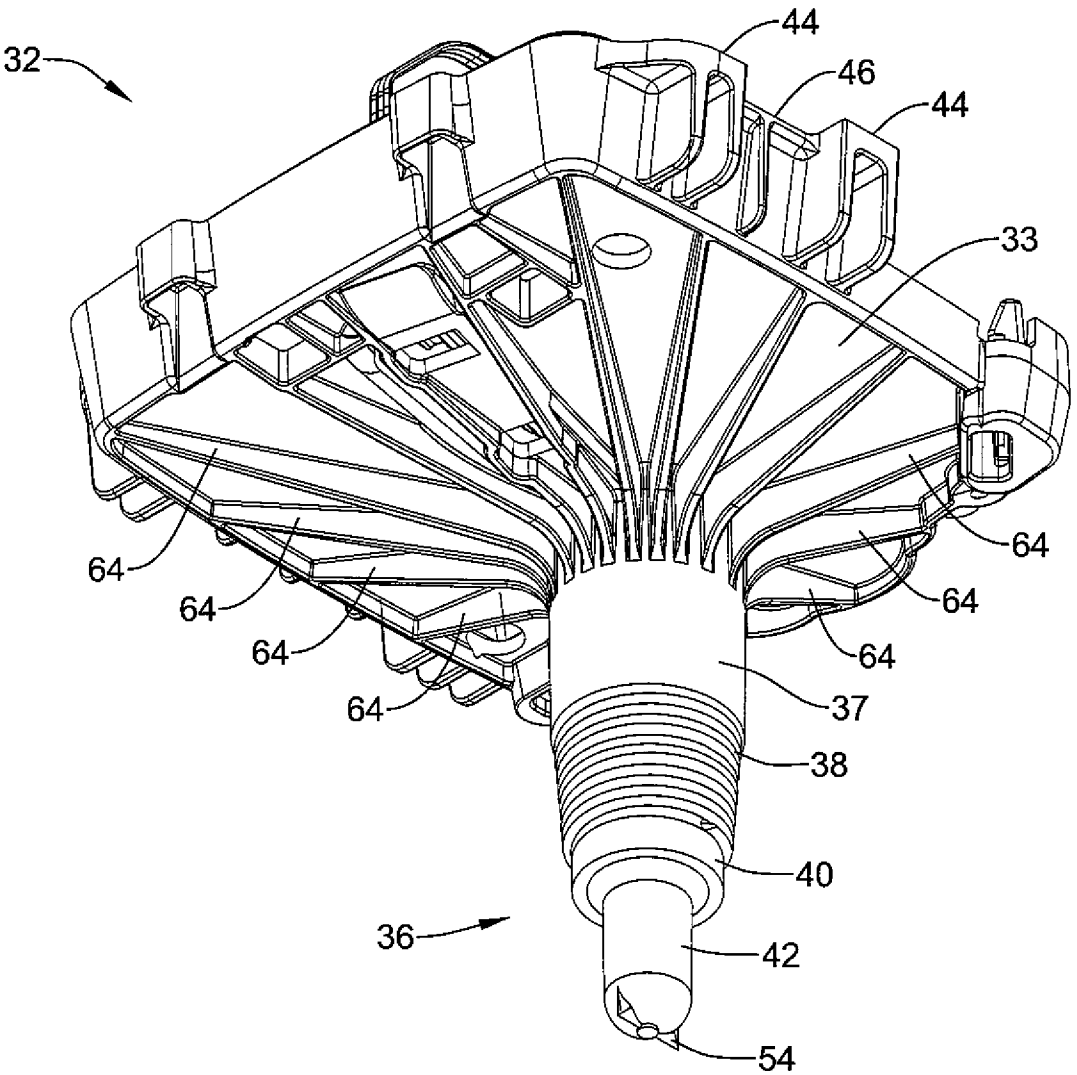
FIG. 5 is another perspective view of the illustrative but non-limiting mounting bracket of FIG. 3.

FIG. 5 is another perspective view of the illustrative but non-limiting mounting bracket of FIG. 3. In the illustrative but non-limiting example, the bracket 32 includes a number of outer ribs 64 extending along the back of component retaining region 33 of bracket 32 and to the first region 37 of sensor portion 36. For clarity, not all ribs 64 have been identified with a reference numeral. In some cases, outer ribs 64 may not extend all the way to sensor portion 36, while in other cases, ribs 64 may extend further along sensor portion 36 towards threaded region 38. The number of ribs 64 may vary as desired depending on the application. For example, bracket 32 may have zero ribs 64, as few as one rib 64, more than 14 ribs, or any other number of ribs 64 as desired. As shown, the ribs 64 may radiate out from the elongated stem of the sensor region 36, but this is not required.

It is contemplated that the ribs 64 may provide additional strength to bracket 32. In some cases, the ribs 64 may be sufficient for the bracket 32 to withstand a 500 pound-force (lbf) static vertical load (roughly equivalent to a 300 lb person stepping on the installed bracket). When so provided, bracket 32 may resist accidental breakage. In the event bracket 32 breaks or fails, however, bracket 32 may have other safety features to help prevent a user from being exposed to hot water from the water tank 12, as will be discussed in more detail below with respect to FIG. 7.

Figure 6:
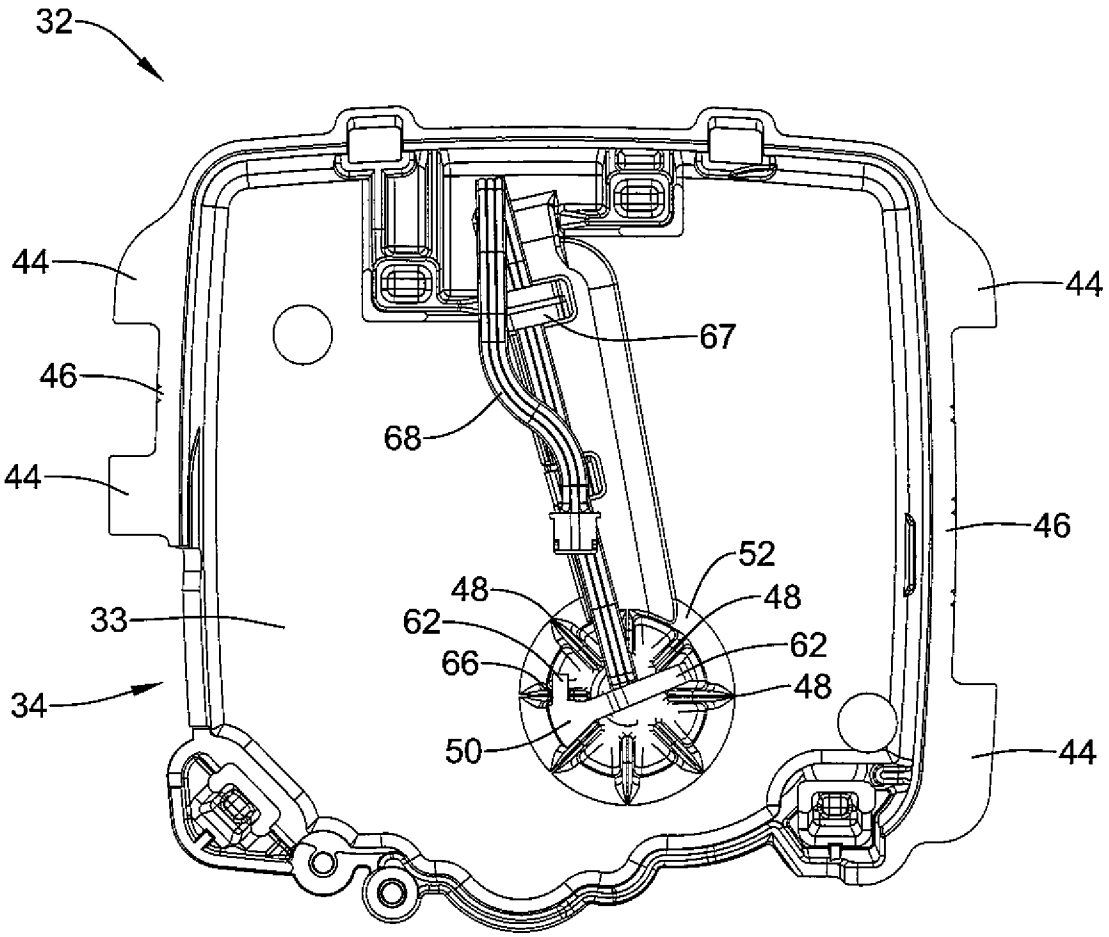
FIG. 6 is a top plan view of the illustrative but non-limiting mounting bracket of FIG. 3.

FIG. 6 is a top plan view of the illustrative but non-limiting mounting bracket 32 of FIG. 3, with the temperature sensor assembly 49 positioned within void 52 such that temperature sensor 56 is disposed within the internal well 39. As discussed above, and in some embodiments, one or more protrusions 62 may be positioned between internal ribs 48 or within slot 66. Internal ribs 48 may be radially spaced within void 52. While ribs 48 are illustrated as equally spaced around the circumference of void 52, it is contemplated that internal ribs 48 may be spaced at any distance desired, or may not be present at all. Additionally, while void 52 is illustrated as having a circular cross-section, it is contemplated that void 52 may have any cross-section shape as desired, such as, but not limited to, square, rectangular, elliptical, or polygonal. Wiring harness 68 may be configured to extend from temperature sensor assembly 49 and to a gas control unit, such as the gas control unit 18 illustrated in FIG. 1. Component retaining region 33 may include retaining elements 67 for retaining wiring harness 68. Retaining elements 67 may be molded in such a way as to allow the use of an optical sensor in production to ensure that the wiring harness 68 and/or sensor wires are properly installed. For example, bracket 32 may be molded such that an opening is present behind retaining elements 67. While not explicitly shown, component retaining region 33 may also include retaining elements for retaining a water heater controller module and/or gas valve module, if desired.

Figure 7:
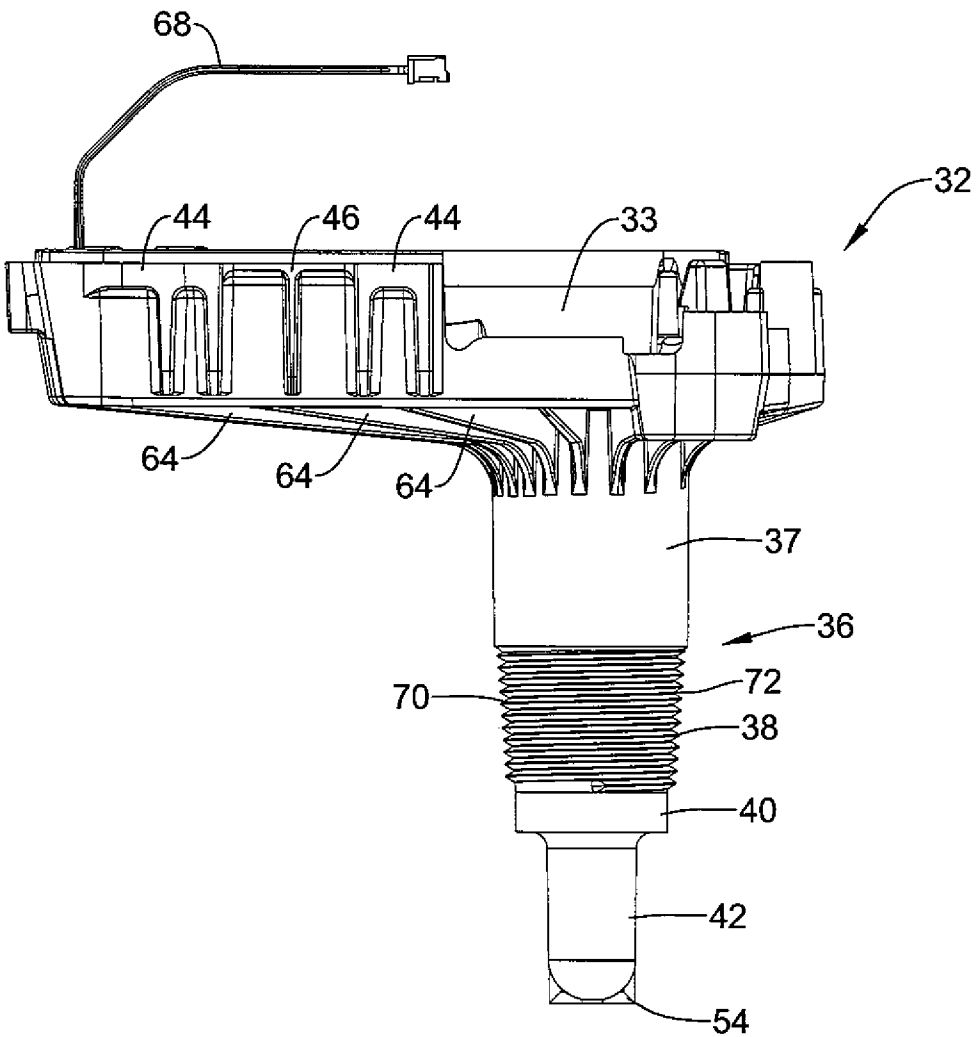
FIG. 7 is a side view of the illustrative but non-limiting mounting bracket of FIG. 3.

FIG. 7 is a side view of the illustrative but non-limiting mounting bracket of FIG. 3, with the temperature sensor assembly 49 disposed within void 52 (not explicitly shown). Threaded region 38 may be configured to provide additional safety features to bracket 32, if desired. For example, threaded region 38 may include a plurality of threads 70 spaced a distance apart. Geometric dimensioning and tolerancing may be used to control the angle and roundness of the threads 70. In some embodiments, threads 70 may be spaced such that there are 13.9-14.0 threads per inch. In other embodiments, it is contemplated that there may be more or fewer threads per inch. In one example, threads 70 may be spaced to ensure that the material in the threads 70 is in compression, and not in tension. This may increase the strength of the threaded region 38 when torque is being applied during installation of the bracket 32, as well as increasing the strength to support a vertical load. In some cases, threaded region 38 may be able to withstand 75 foot-pounds (ft-lbs), or more, of torque. In some embodiments, the root 72 of threads 70 may be rounded to relieve stress in the threads 70. A round root 72 may increase the strength during application of torque as well as for a vertical load.

In the event that a torque or a vertical load is applied to the bracket 32 that exceeds the design load limits, or the bracket 32 is otherwise sufficiently stressed, bracket 32 may break in a sudden manner resulting in a brittle fracture. A suitable material for creating such a break is Dupont™ Zytel® 70G33, however, other materials may be used. The stress from such an event may be concentrated in the last thread 70 that engages the water heater spud. A brittle material may result in a clean break at or near the outside edge of the water heater spud such that the portion of the sensor portion 36 that has been threadably engaged with the water heater spud remain positioned within the water heater spud. For example, if a breakage occurs, the distal portion 42 and part of the threaded region 38 of the sensor portion 36 may remain disposed within the water tank 12 and water heater spud. This may help prevent significant leakage of hot water from the water heater. Once the water is removed, or the water is cooled, the internal ribs 48 (see FIG. 6) disposed within the void 52 may be used to axially align a removal tool, for example, an aggressive Easy-Out such as a Walton #4 pipe, stud, and screw extractor or equivalent, and to provide a surface to which torque may be applied to remove the broken off portion of the bracket 32 from the water heater. If ribs 48 are not present in the remaining portion of the sensor portion 36, a removal tool having sharp blades may dig into the interior surface of the internal well 39 to remove the broken off portion.

In some instances, the mounting bracket 32 may screw into a threaded spud on the side of a water heater 10 and go through the water heater insulation. As the insulation thickness on the water heater 10 increases, the sensor portion 36 on the bracket 32 may need to get longer. A longer sensor portion 36, however, may decrease the load that the mounting bracket 32 can withstand. In some instances, this may be compounded by the fact that the threads 38 on the sensor portion 36 of the mounting bracket 32 that extend outside of the spud may create a stress riser.

Figure 8:
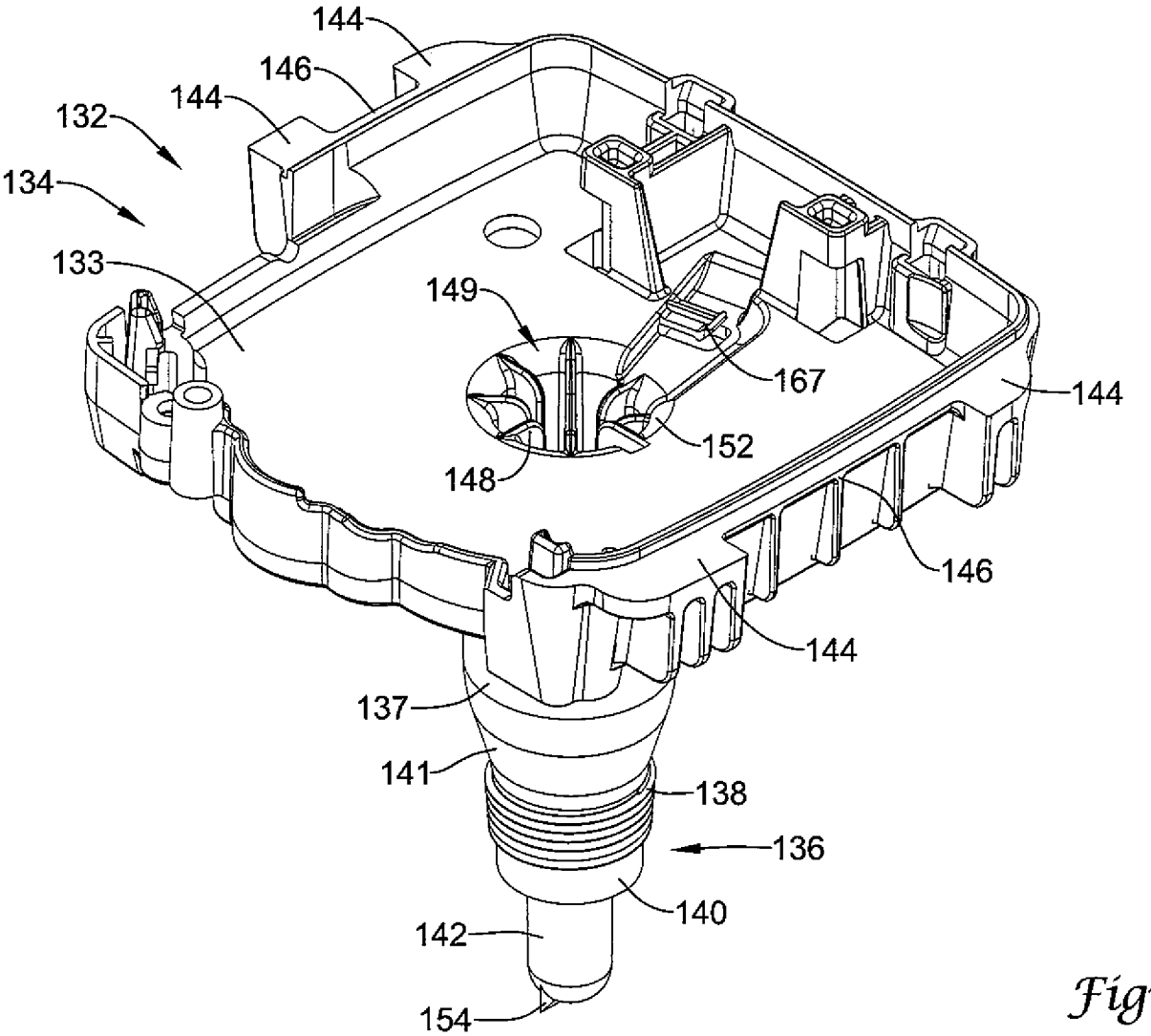
FIG. 8 is a perspective view of an illustrative but non-limiting mounting bracket that may be used in conjunction with the water heater of FIG. 1.

FIG. 8 is a perspective view of an illustrative but non-limiting mounting bracket 132 illustrating an alternative sensor portion 136 that may increase the downward load that the mounting bracket 132 can withstand. Like above, the mounting bracket 132 may include a component retaining portion 133, and a sensor portion 136 that includes an elongated stem. The illustrative bracket 132 may be configured to retain, for example, a gas valve module and/or a water heater controller module (not explicitly shown) within component retaining region 133, as well as a temperature sensor assembly (not explicitly shown, see also FIG. 4) within the sensor portion 136. In the illustrative embodiment of FIG. 8, bracket 132 may include a gas valve retaining portion 134 that may form at least a portion of a housing of a gas control unit, such as gas control unit 18 of FIG. 1, but this is not required. In some instances, and as illustrated in FIG. 8, elongated sensor portion 136 may include a threaded portion 138 that can be used to secure bracket 132 to or within aperture 30 (FIG. 2) of a water heater spud.

It is contemplated that bracket 132 may be formed of any suitable material. In some instances, bracket 132 may include non-metallic materials such as a polymeric material, glass, ceramic, plastic, and the like. In some cases, bracket 132 may be manufactured as a single piece by injection molding a nylon material such Zytel® 70G33 glass-filled nylon, available from DuPont in Wilmington, Del. The thermal conductivity of such non-metallic materials may be less than those of metallic materials, and as a result, may partially thermally isolate the temperature sensor assembly from the water in the water tank 12, but may be less expensive to produce than a metallic well. It is contemplated that in some cases, bracket 132 may not be formed entirely from the same material, or bracket 132 may not be formed as a single piece. In some cases, bracket 132 may include both a metallic material and a non-metallic material. Also, and as will be discussed in more detail with respect to FIG. 12, bracket 132 may incorporate safety features to help minimize injury from hot water in the event bracket 132 becomes broken or damaged after installation.

Sensor portion 136 of the bracket 132 may include an elongated stem extending from component retaining region 133. Sensor portion 136 may include an internal well 139 (shown in more detail in FIG. 9) for receiving a temperature sensor assembly. While the temperature sensor assembly is not explicitly shown, it is contemplated that a temperature sensor assembly similar to that described above with respect to FIGS. 4 and 4A may be used. The elongated stem of sensor portion 136 may include several different regions. For example, sensor portion 136 may include a first region 137, a tapered region 141, a threaded region 138 extending around the exterior of the sensor portion 136, a thread lead-in region 140, and an enclosed distal end region 142. Threaded region 138 may be configured to threadably engage a threaded spud of the water tank 12. In some cases, the threaded region 138 may provide NPT threads that have a taper angle of between 1 and 8 degrees, and more preferably between 3 an 7 degrees. This may help create a good seal between threaded region 138 and the threads of the water heater spud. Thread lead-in region 140 may be disposed between the distal end region 142 and the threaded region 138, and may be configured to help guide the sensor portion 136 into the aperture 30 of the water tank 12 with proper alignment for the threaded region 138 to engage the threaded spud in the water tank 12.

In some embodiments, the thread lead-in region 140 may have zero draft (i.e. has an out wall that is parallel with a central axis of the elongated sensor portion 136), but this is not required. When threaded region 138 is engaged with a threaded water heater spud, distal end 142 may be disposed within the water tank 12 of the water heater. As such, distal end 142 may house a temperature sensor such that when the bracket 132 is engaged with the water tank 12, the temperature sensor is in at least partial thermal contact with the water in the water tank 12.

In some instances, first portion 137 and tapered region 141 may have a larger wall thickness than that of threaded region 138 and thread lead-in region 140. Tapered region 141 may gradually increase the wall thickness from the threaded region 138 to the first portion 137, as better shown in FIG. 9. This may increase the strength of the sensor portion 136 while not providing a discontinuity or sharp change in wall thickness that might create a stress collection region that could provide a fracture point. It is contemplated that in some instances, threaded region 138 may have the same wall thickness or, alternatively, a greater wall thickness than the first portion 137. In either cases, an increased wall thickness along the elongated sensor portion 136 may help the bracket 132 withstand a greater vertical load.

In some instances, distal end region 142 may have a reduced cross-sectional area relative to remaining regions 137, 138 and 140 of sensor portion 136. However, it is contemplated that in some cases, the cross-sectional area of distal end 142 may be the same as, or substantially the same as the remaining regions 137, 138 and 140 of sensor portion 136. In some embodiments, distal end 142 may include a cutting element 154 disposed at or near the tip. In some instances, the cutting element 154 may include a blade-like feature. Cutting element 154 may aid in puncturing and/or piercing a plastic sheet or barrier commonly wrapped around the water tank 12 of many water heaters during installation of the bracket 132. It is contemplated that in some cases, the cutting element 154 may be omitted from the design, if desired.

In some embodiments, bracket 132 may also include two (or more) bosses 144 on a first lateral side, and two (or more) bosses 144 on a second opposing lateral side. While bracket 132 is shown having four bosses 144, it is contemplated that bracket 132 may have any number of bosses 144 as desired, for example, but not limited to, one, two, three, or more. Additionally, it is contemplated that bosses 144 may be disposed on fewer than, or more than, two lateral sides. Bosses 144 may provide, among other things, an area for torque to be applied directly to the bracket 132 during installation. For example, an installation tool may grip and apply torque to bosses 144 to threadably engage threaded region 138 of sensor portion 136 with a threaded water heater spud on a water tank 12. In some instances, bosses 144 may further include a rib 146 disposed between adjacent bosses 144. Rib(s) 146 may provide additional support to the bracket 132, and may also help prevent an installation tool from contacting the component retaining region 133 of bracket 132 during installation.

As discussed in greater detail with respect to FIG. 4, a sensor assembly structure may be inserted into a void 152 that is molded or otherwise formed within sensor portion 136. The sensor assembly structure may include one or more protrusions that may help to locate the sensor assembly structure within void 152 and/or limit penetration of the sensor assembly structure into void 152 while allowing a wiring harness to pass without being pinched. The one or more protrusions may align the sensor assembly structure with inwardly extending ribs 148 disposed on the inner walls of the sensor portion 136 and into the void 152. The one or more protrusions, in cooperation with one or more ribs 148, may in some instances help properly align and assemble the temperature sensor assembly within the sensor portion 136. The one or more protrusions may also help ensure that sensor assembly is not installed in the wrong bracket. When the temperature sensor assembly is assembled within sensor portion 136, the sensor may be disposed within an internal well 139 within the distal tip portion 142 of the sensor portion (see FIG. 9).

Figure 9:
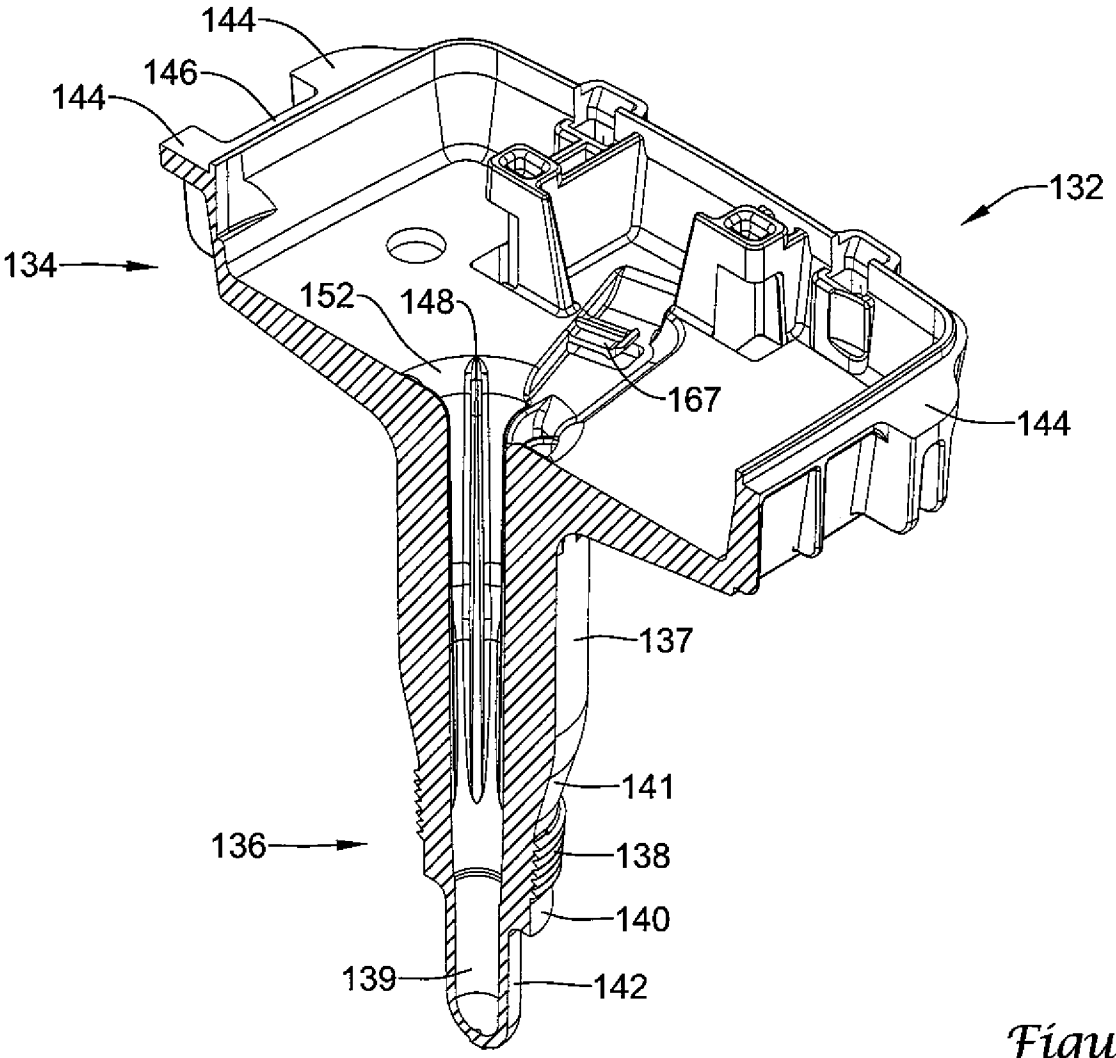
FIG. 9 is a perspective view, partially in cross-section, of the illustrative but non-limiting mounting bracket of FIG. 8.

FIG. 9 is a perspective view, partially in cross-section, of the illustrative but non-limiting mounting bracket of FIG. 8. As discussed above, the void 152 within the sensor region 136 may include inwardly extending ribs 148. Ribs 148 may extend any length along the void 152, as desired. While ribs 148 are shown extending to a middle portion of threaded region 138, it is contemplated in some embodiments, ribs 148 may extend past threaded region 138. In other embodiments, ribs 148 may terminate short of threaded region 138, or at any point within threaded region 138. It is further contemplated that there may be any number of ribs 148 as desired, for example, but not limited to, one, two, three, four, or more. In some embodiments, sensor portion 136 may include one or more slots (not explicitly shown) for receiving one or more protrusions such as protrusion 62 that may help locate temperature assembly structure 150 within void 152 and/or limit penetration of temperature assembly structure 150 into void 152.

Figure 10:
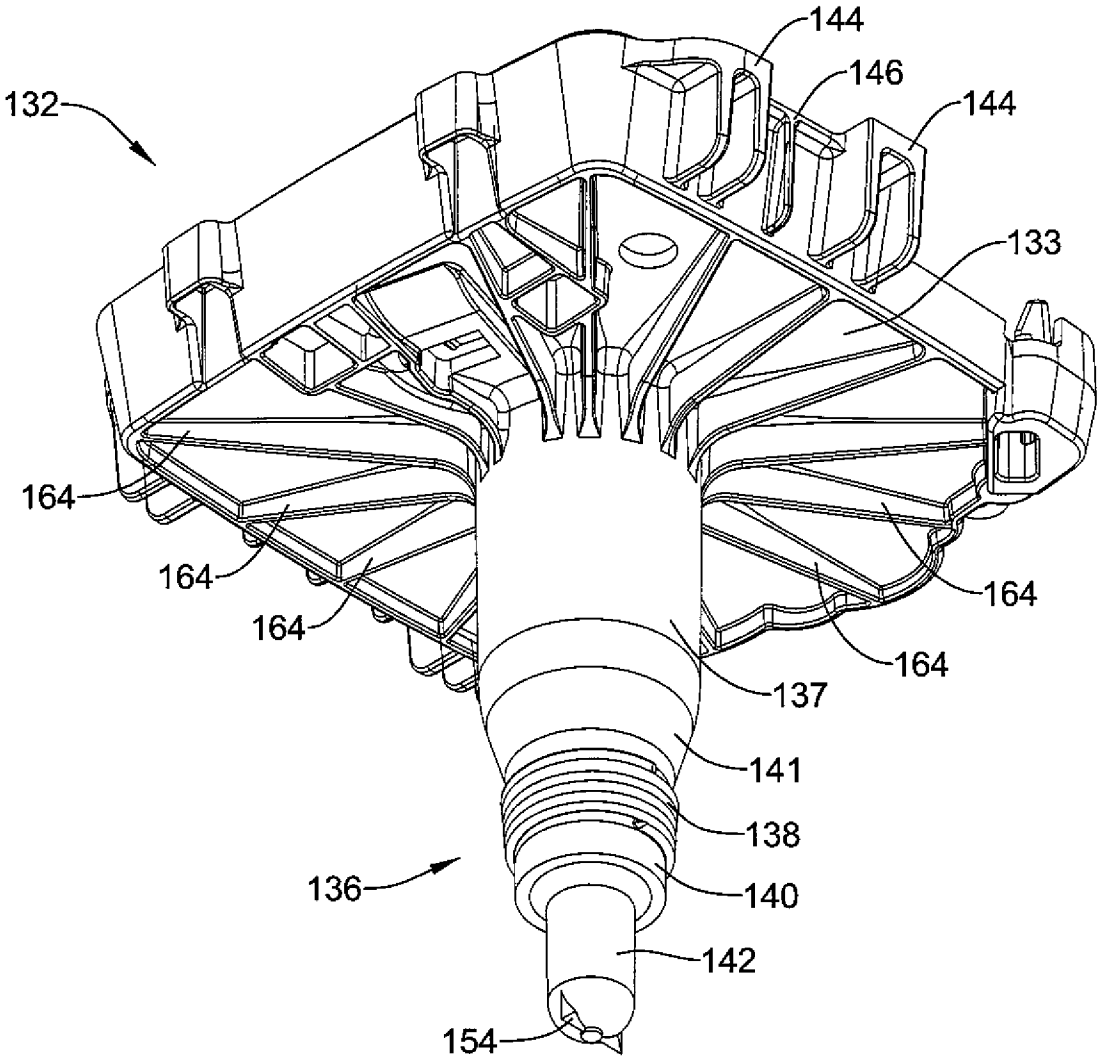
FIG. 10 is another perspective view of the illustrative but non-limiting mounting bracket of FIG. 8.
Figure 13:
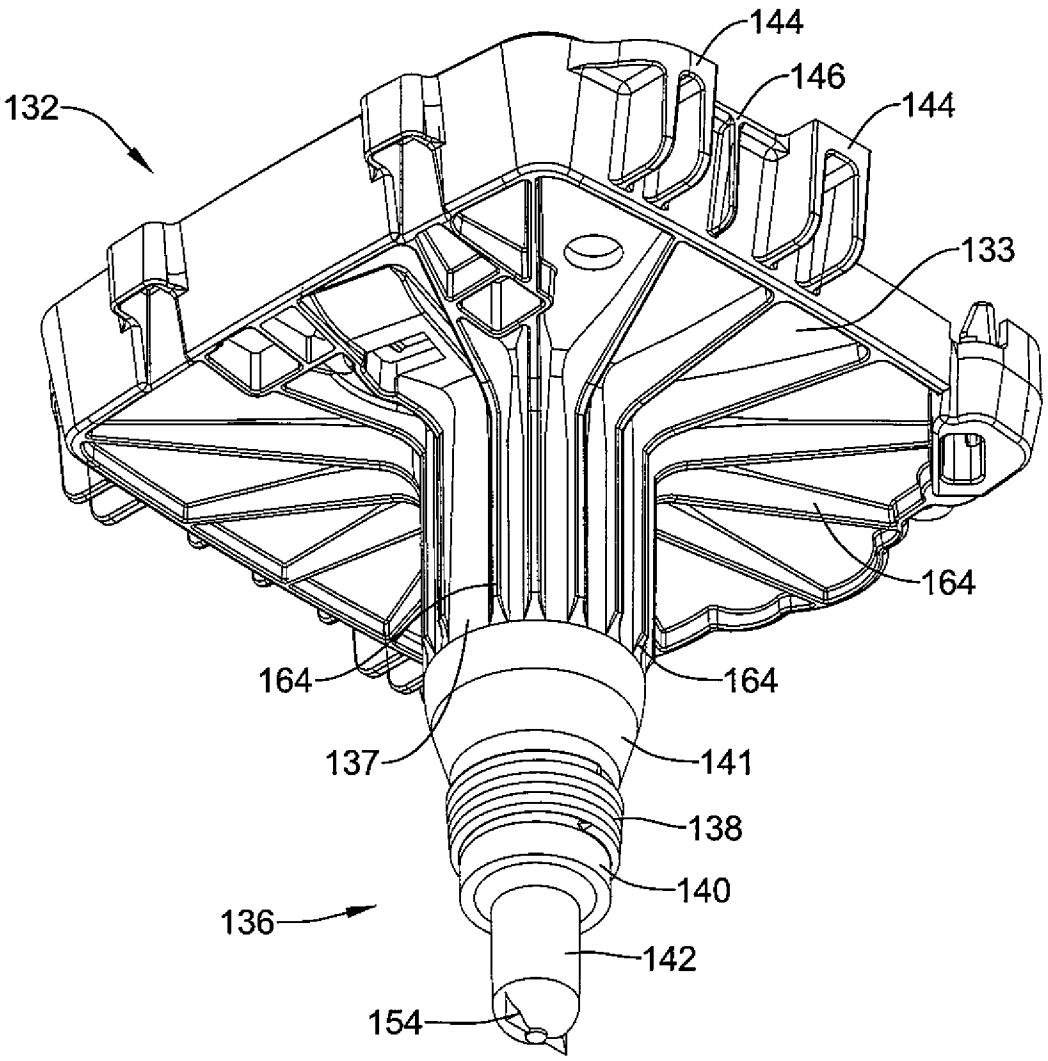
FIG. 13 is a perspective view of another illustrative but non-limiting mounting bracket.

FIG. 10 is another perspective view of the illustrative but non-limiting mounting bracket of FIG. 8. In the illustrative but non-limiting example, the bracket 132 includes a number of outer ribs 164 extending along the back of component retaining region 133 of bracket 132 and to the first region 137 of sensor portion 136. For clarity, not all ribs 164 have been identified with a reference numeral. In some cases, outer ribs 164 may not extend all the way to sensor portion 136, while in other cases, ribs 164 may extend further along sensor portion 136 towards threaded region 138 (see FIG. 13). The number of ribs 164 may vary as desired depending on the application. For example, bracket 132 may have zero ribs 164, as few as one rib 164, more than 14 ribs, or any other number of ribs 164 as desired. As shown, the ribs 164 may radiate out from the elongated stem of the sensor region 136, but this is not required. In some cases, the ribs 164 may be outward extensions of the inwardly extending ribs 148 disposed on the inner walls of the sensor portion 136, but this is not required.

It is contemplated that the ribs 164 may provide additional strength to bracket 132. In some cases, the ribs 164 may be sufficient for the bracket 132 to withstand up to a 650 pound-force (lbf) or more static vertical load. When so provided, bracket 132 may resist accidental breakage. In the event bracket 132 breaks or fails, however, bracket 132 may have other built-in safety features to help prevent a user from being exposed to hot water from the water tank 12, as will be discussed in more detail below with respect to FIG. 12.

Figure 11:
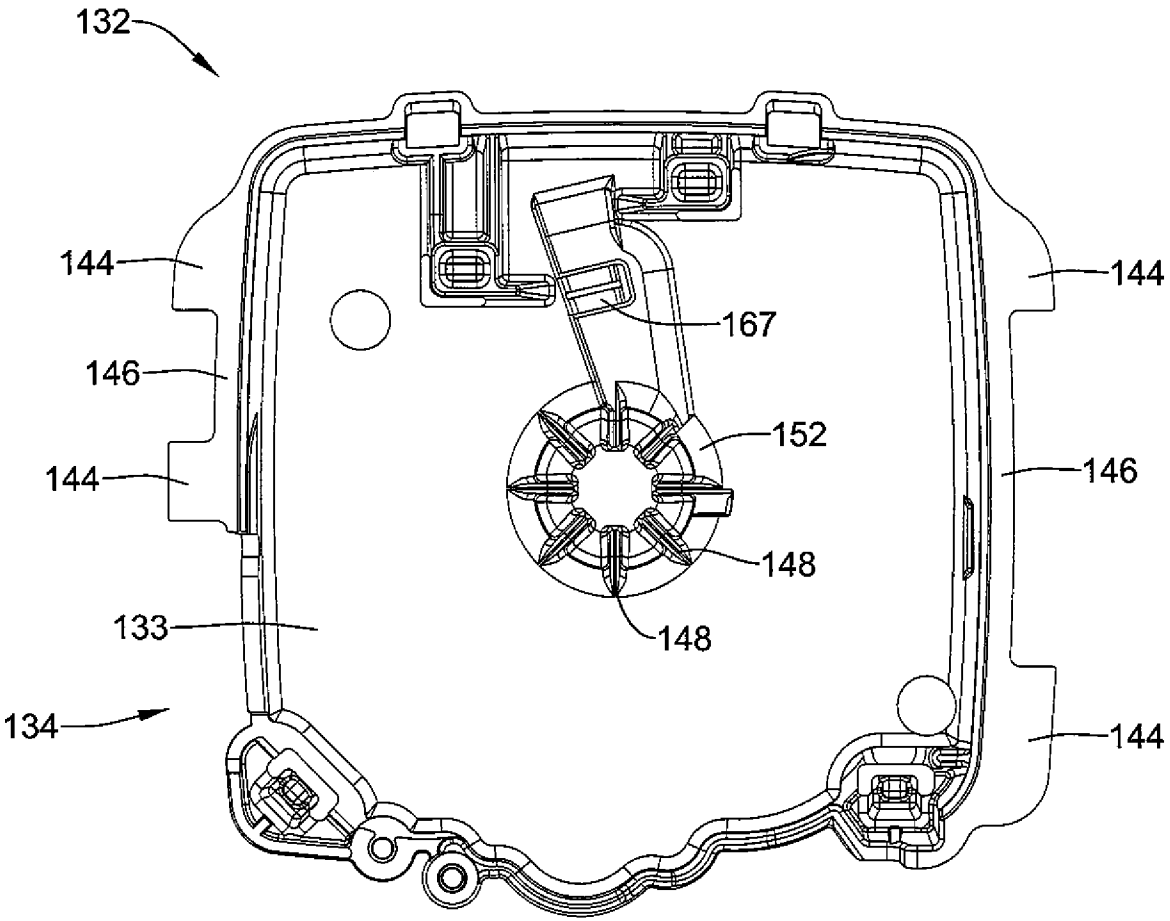
FIG. 11 is a top plan view of the illustrative but non-limiting mounting bracket of FIG. 8.

FIG. 11 is a top plan view of the illustrative but non-limiting mounting bracket 132 of FIG. 8. As discussed above, and in some embodiments, one or more protrusions of a temperature sensor assembly may be positioned between internal ribs 148. Internal ribs 148 may be radially spaced within void 152. While ribs 148 are illustrated as equally spaced around the circumference of void 152, it is contemplated that internal ribs 148 may be spaced at any distance desired, or may not be present at all. Additionally, while void 152 is illustrated as having a circular cross-section, it is contemplated that void 152 may have any cross-section shape as desired, such as, but not limited to, square, rectangular, elliptical, or polygonal. Further, while void 152, and thus elongate sensor region 136, is illustrated as being approximately centrally located within the component containing region 133, it is contemplated that the elongate sensor region 136 may be offset from the center in any position desired.

A wiring harness may be configured to extend from a temperature sensor assembly and to a gas control unit, such as the gas control unit 18 illustrated in FIG. 1. Component retaining region 133 may include retaining elements 167 for retaining such a wiring harness. Retaining elements 167 may be molded in such a way as to allow the use of an optical sensor in production to ensure that the wiring harness and/or sensor wires are properly installed. For example, bracket 132 may be molded such that an opening is present behind retaining elements 167. While not explicitly shown, component retaining region 133 may also include retaining elements for retaining a water heater controller module and/or gas valve module, if desired.

Figure 12:
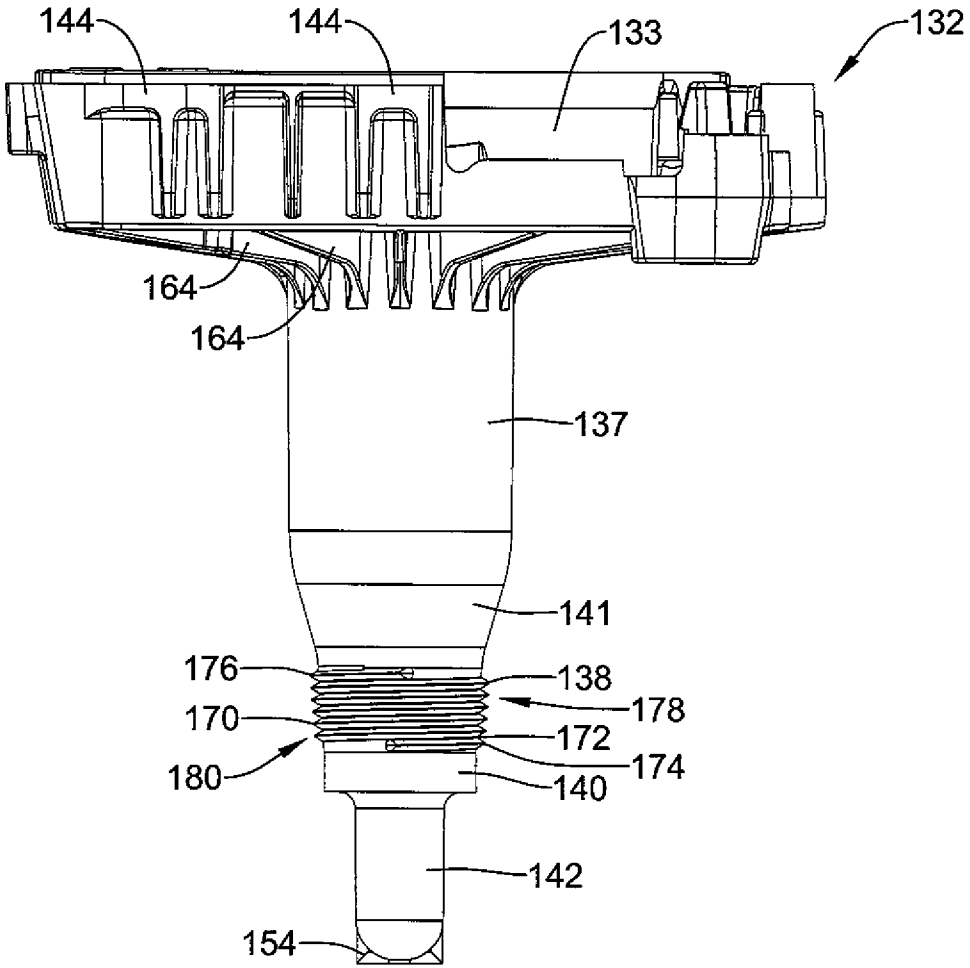
FIG. 12 is a side view of the illustrative but non-limiting mounting bracket of FIG. 8.

FIG. 12 is a side view of the illustrative but non-limiting mounting bracket of FIG. 8. Threaded region 138 may be configured to provide additional safety features to bracket 132, if desired. Threaded region 138 may include a plurality of threads 170 spaced a distance apart. In some instances, the first exposed thread may create a stress riser and thus a fracture point for the bracket. Eliminating exposure of the first and other threads may reduce and/or possibly eliminate the stress riser. As such, and in some instances, threaded region 138 may be configured such that when the sensor portion 136 is fully threadably engaged within a water tank 12, the outside thread 176 of the threaded region 138 is disposed within the threaded region of the spud of the water tank 12 (e.g. no threads of the threaded region extend external of the threads of the water heater spud). When so provided, the outside thread 176 of the threaded region 138 may be supported by the threads of the water heater spud. In some cases, the outside thread 176 may have an additional radius or filet along the outside root. This may help reduce a stress riser that may develop along the outside edge of the outside thread 176. In some cases, the threaded region 138 may have a length that is less than the threaded spud thickness, but this is not required.

In some instances, it is contemplated that the outside (or first) thread 176 and the inside (or last) thread 174 may be begin/end on a lateral side of the sensor portion 136 when the bracket 132 is assembled with a threaded spud of a water heater 10, as shown in FIG. 12. In some embodiments, this orientation may reduce the stress at those points. In some instances, the last thread 174 may be a high stress point or stress riser if it was located at the top or bottom of the sensor portion 136 when assembled with the threaded spud of the water heater 10 instead of on a lateral side. Although it is not an absolute requirement, positioning the end of the threads laterally may increase the strength of the bracket 132. In some instances, the beginning point of the first thread 176 and the termination point of the last thread 174 may be generally positioned on the same lateral side, but this is not required.

It is contemplated that geometric dimensioning and tolerancing may be used to control the angle and roundness of the threads 170. In some embodiments, threads 170 may be spaced such that there are 13.9-14.0 threads per inch. In other embodiments, it is contemplated that there may be more or less threads per inch. In one example, an outside portion 178 of the threaded region 138 may be in tension while an inside portion 180 of the threaded region 138 may be in compression, and a middle portion of the threaded region 138 may be relatively stress-free. In another example, threads 170 may be spaced to ensure that the material in the threads 170 is in compression, and not in tension. In either case, this may tend to increase the strength of the threaded region 138 when torque is being applied during installation of the bracket 132, as well as to support a vertically applied load. In some cases, threaded region 138 may be able to withstand 75 foot-pounds (ft-lbs), or more, of torque. In some embodiments, the root 172 of threads 170 may be rounded to relieve stress in the threads 170. A round root 172 may increase the strength during application of torque as well as when vertical loads are applied.

In the event that a torque or a vertical load is applied to the bracket 132 that exceeds the design load limits, or the bracket 132 is otherwise sufficiently stressed, bracket 132 may break in a sudden manner resulting in a brittle fracture. A suitable material for creating such a break is DuPont™ Zytel® 70G33, however, other materials may be used. The stress from such an event may be concentrated in the last thread 170 that engages the water heater spud. A brittle material may result in a clean break at or near the outside edge of the water heater spud such that the portion of the sensor portion 136 that has been threadably engaged with the water heater spud remain positioned within the water heater spud. For example, if a breakage occurs, the distal portion 142 and most of the threaded region 138 of the sensor portion 136 may remain disposed within the water tank 12 and water heater spud. This may help prevent significant leakage of hot water from the water heater when a break occurs. Once the water is removed, or the water is cooled, the internal ribs 148 (see FIG. 11) disposed within the void 152 may be used to axially align a removal tool, for example, an aggressive Easy-Out such as a Walton #4 pipe, stud, and screw extractor or equivalent, and to provide a surface to which torque may be applied to remove the broken off portion of the bracket 132 from the water heater spud. If ribs 148 are not present in the remaining portion of the sensor portion 136, a removal tool having sharp blades may be used to dig into the interior surface of the internal well 139 to remove the broken off portion, if desired.

Figure 14:
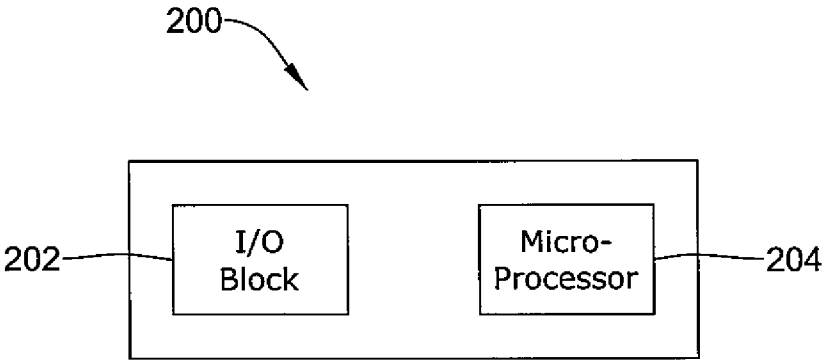
FIG. 14 is a block diagram of a controller that may be used with the water heater of FIG. 1.

Returning briefly to FIG. 1, it will be appreciated that gas control unit 18 may include a controller. FIG. 14 is a block diagram of such a controller 200. The controller 200 may be considered as being a portion of gas control unit 18, or separate from gas control unit 18. Controller 200 may have several modules. In some cases, controller 200 may have an INPUT/OUTPUT block 202 that accepts signals from temperature sensor 28 (FIG. 1) and/or temperature sensor assembly 49 (FIG. 3). If water heater 10 is in communication with an external thermostat or other HVAC controller, INPUT/OUTPUT block 202 may accommodate externally-derived control signals, and/or provide status and/or other information, as desired. In some cases, INPUT/OUTPUT block 202 may also provide appropriate output command signals to an electrically controlled gas valve (not illustrated) within gas control unit 18.

In some instances, controller 200 may include a microprocessor 204 that may be configured to accept appropriate signals from INPUT/OUTPUT block 202, and to determine appropriate output signals that can be outputted via INPUT/OUTPUT block 202, such as to other components within gas control unit 18 (FIG. 1) and/or to an external thermostat or other HVAC controller. Microprocessor 204 may be programmed to accept a temperature signal from temperature sensing assembly 32, 132 (FIGS. 3 and 8), and to calculate or otherwise determine a command temperature that alters the temperature value received from the temperature sensing assembly 32, 132 in order to account or compensate for temperature differentials and/or thermal lag caused by the partial thermal isolation (if present) of the temperature sensor 56 from the water in the water tank 12. While not explicitly illustrated, microprocessor 204 may also include memory and/or other components. A further discussion of the operation of one illustrative controller 200 and algorithms can be found in co-pending U.S. patent application Ser. No. 12/255,592, filed Oct. 21, 2008, and entitled "WATER HEATER WITH PARTIALLY THERMALLY ISOLATED TEMPERATURE SENSOR", the entirety of which is incorporated herein by reference.

The disclosure should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

We claim:

1. A bracket for a water heater with a water tank, the bracket comprising:

a polymeric body having a component retaining region and an elongated sensor portion extending from the component retaining region, the elongated sensor portion configured to receive a temperature sensor at least partially within the elongated sensor portion;

wherein the elongated sensor portion includes a threaded portion that is configured to threadably engage a threaded spud of the water heater such that at least part of the elongated sensor portion extends into the water tank of the water heater; and wherein the threaded portion has a first thread and a last thread oriented such that the first thread begins and the last thread terminates on a lateral side of the threaded portion when the bracket is assembled with a water heater.

2. A bracket for a water heater with a water tank, the bracket comprising: a polymeric body having a component retaining region and an elongated sensor portion extending from the component retaining region, the elongated sensor portion configured to receive a temperature sensor at least partially within the elongated sensor portion; wherein the elongated sensor portion includes a threaded portion that is configured to threadably engage a threaded spud of the water heater such that at least part of the elongated sensor portion extends into the water tank of the water heater;

wherein the elongated sensor portion includes an elongated stem that has an internal well for receiving the temperature sensor; and wherein the internal well is defined, at least in part, by a wall having one or more ribs, wherein the ribs are configured to properly position the temperature sensor within the well.

3. The bracket of claim 2, wherein the threaded portion extends around the elongated sensor portion.

4. The bracket of claim 2, wherein the elongated sensor portion has a distal end that terminates inside of the water tank when the bracket is installed on the water heater, and wherein the elongated sensor portion includes a thread lead in region between the threaded portion and the distal end of the elongated sensor portion, the thread lead in region guiding the bracket relative to the water heater before the threaded portion of the elongated sensor portion threadably engages the threaded spud of the water heater.

5. The bracket of claim 1, wherein the elongated sensor portion has a distal end that terminates inside of the water tank when the bracket is installed on the water heater, and wherein the wall thickness of the threaded portion has a greater wall thickness than the distal end.

6. The bracket of claim 1, wherein the elongated sensor portion has a distal end that terminates inside of the water tank when the bracket is installed on a water heater, and wherein the distal end includes a blade element to help pierce a barrier when the bracket is installed on a water heater.

7. The bracket of claim 1, wherein the polymeric body includes a material that, when sufficiently stressed, fractures suddenly in a clean break.

8. The bracket of claim 7, wherein the polymeric body includes DuPont Zytel 70G33.

9. The bracket of claim 1, wherein the component retaining region includes two or more ribs for providing additional support to the component retaining region.

10. The bracket of claim 9, wherein the component retaining region includes retaining elements for retaining a gas valve module.

11. The bracket of claim 10, wherein the component retaining region includes retaining elements for retaining a water heater controller module.

12. The bracket of claim 8, wherein the component retaining region includes a first boss along one lateral side and a second boss along the same lateral side, with a rib extending between the first boss and the second boss.

13. The bracket of claim 1, wherein the polymeric body is molded as a single piece.

14. A bracket for a water heater with a water tank, the bracket comprising:

a body having a component retaining region and an elongated sensor region extending from the component retaining region, the elongated sensor region having an internal well for receiving a temperature sensor;

the elongated sensor region including a threaded portion that extends around the elongated sensor region for threadably engaging a threaded spud of a water heater such that at least part of the elongated sensor region extends into the water tank of the water heater;

the elongated sensor region having a first region positioned between the component containing region and the threaded portion, an outer surface of the first region defining a larger cross-sectional area than an outer surface of the threaded portion, and the threaded portion having a thinner wall thickness than the first region; and the elongated sensor region further including a tapered region positioned between the threaded portion and the first region, the tapered region having a tapered wall thickness between the thinner wall thickness of the threaded portion and the thicker wall thickness of the first region.

15. The bracket of claim 14, wherein the body is molded as a single piece from a polymeric material.

16. The bracket of claim 14, wherein the threaded portion is configured such that, when the threaded portion is threadably engaged with the threaded spud, an outside region of the threaded portion is in tension and an inside region of the threaded portion is in compression.

* * * * *